US006076081A

United States Patent [19]

Bass et al.

[11] Patent Number: 6,076,081

[45] Date of Patent: Jun. 13, 2000

[54] PROTOCOL CONVERTER WITH PERIPHERAL MACHINE TRIP CAPABILITY

[75] Inventors: Edward R. Bass, Trumbull; Konstantin G. Kodonas, Norwalk; Vincent R. Weis, Sandy Hook, all of Conn.

[73] Assignee: Pitney Bowes Inc., Stamford, Conn.

[21] Appl. No.: 08/910,868

[22] Filed: Aug. 13, 1997

[51] Int. Cl.[7] ..... G07B 17/00

[52] U.S. Cl. ..... 705/401; 705/410; 709/230

[58] Field of Search ..... 395/200.6, 651, 395/652, 653; 705/401, 410; 709/230; 713/1, 2, 3

[56] References Cited

U.S. PATENT DOCUMENTS

| | | | |
|---|---|---|---|
| 4,301,507 | 11/1981 | Soderberg et al. | 705/410 |
| 4,308,579 | 12/1981 | Dlugos | 705/407 |
| 4,410,961 | 10/1983 | Dlugos et al. | 364/900 |
| 4,466,079 | 8/1984 | Daniels et al. | 705/407 |
| 4,498,187 | 2/1985 | Soderberg et al. | 375/369 |
| 4,525,785 | 7/1985 | Soderberg et al. | 705/410 |
| 4,535,421 | 8/1985 | Duwel et al. | 364/900 |
| 5,009,276 | 4/1991 | Raikes et al. | 177/25.15 |
| 5,050,078 | 9/1991 | Sansone | 705/30 |
| 5,159,684 | 10/1992 | Kroll et al. | 710/104 |
| 5,202,914 | 4/1993 | Kim | 379/97 |
| 5,206,812 | 4/1993 | Abumehdi | 705/410 |
| 5,666,292 | 9/1997 | Hunter et al. | 710/62 |
| 5,737,426 | 4/1998 | Brookner et al. | 380/51 |

FOREIGN PATENT DOCUMENTS

0898248 A2 2/1999 European Pat. Off. .

*Primary Examiner*—Edward R. Cosimano
*Attorney, Agent, or Firm*—Charles R. Malandra, Jr.; Michael E. Melton

[57] ABSTRACT

A unitary and discrete converter module for interfacing a host computer or postage scale using serial communication to a postage meter and mailing machine using Echoplex communication. The interface provides RS-232 to Echoplex and Echoplex to RS-232 protocol translation in addition to providing trip circuitry to trip this mailing machine.

17 Claims, 2 Drawing Sheets

PROTOCOL CONVERTER WITH PERIPHERAL MACHINE TRIP CAPABILITY

FIELD OF THE INVENTION

The present invention relates to an interface to enable a host computer or host device to conduct two-way communication with a peripheral device where the host and peripheral communicate in different protocols. More particularly, the invention relates to a digital communications protocol converter which not only supports the exchange of messages of different protocols between the two devices but which also provides event trigger signaling related to the communications between the two devices.

Prior Patents

U.S. Pat. No. 4,535,421 issued to Edward C. Duwel and John H. Soderberg, entitled "Universal Real Time Transparent Asynchronous Serial/Echoplex Converter," assigned to the assignee of the present invention, describes an interface for allowing a computer to communicate with a peripheral device in a different protocol than that used by the computer. That device provides a transparent interface for a computer or other processor mechanism to transparently interface with the external apparatus to be controlled. The interface provides two way conversion between serial data communication to and from the computer and a different form of serial communication developed by Pitney Bowes and known as Echoplex communication.

Echoplex communication is a form of serial communication, wherein serial messages are asynchronously transmitted and received. The format of the messages, and the timing of the bits in different units is precisely set, however, to ensure that messages may be sent and received without the necessity for synchronizing each communicating computer. In addition, in Echoplex communication, upon receipt of the first bits of a message from a transmitting unit, the received bits are retransmitted by the receiver back to the transmitter for comparison. This comparison enables the transmitter to determine if any errors have occurred in its transmission, or the receivers reception, of data. Thus, with Echoplex communication, the correctness of each message sent and received is verified within a minimum period of time following the complete message transmission.

The theory of Echoplex communication, and in particular, its application to an electronic postage meter, is disclosed in U.S. Pat. No. 4,301,507, entitled "Electronic Postage Meter Having Plural Computing Systems," and issued to J. H. Soderberg et al., on Nov. 17, 1981, and assigned to the assignee of the present invention. As discussed in that patent, it is sometimes desirable to control the functions of an electronic postage meter from a remote location. In order to accomplish such control, an interface connector is provided in the electronic postage meter, for connection to the remote controller. Thus, for example, connection of an external device, such as an electronic scale, to the postage meter can be made to more fully automate the mailing process.

In order to provide additional opportunities for the remote control of electronic postage meters, an interface is required which will enable the remote controller (e.g., a host computer) to communicate with the postage meter to be controlled. Since the host computer will generally transmit and expect to receive data in a standard serial format, whereas the postage meter may transmit and expect to receive data in an Echoplex serial format, the interface will have to provide for the conversion from one form of serial data to Echoplex data, and vice versa. Such an interface should operate in real time, such that data from the postage meter is received as it is transmitted, and data from the host computer is received by the postage meter as it is transmitted.

The Echoplex communications protocol is further described in U.S. Pat. Nos. 4,498,187 and 4,525,785 to Soderberg et al., both entitled "Electric Postage Meter Having Plural Computing Systems," and assigned to the assignee of the present invention. All of the above listed patents are incorporated herein by reference in their entireties.

U.S. Pat. No. 4,410,961 to Dlugos et al., entitled "Interface Between A Processor System And Peripheral Devices Used In A Mailing System," assigned to the assignee of the present invention, describes a peripheral interface board for establishing a communication link between a postage value determining system processor associated with a postage scale and a plurality of peripheral devices. The weighing device or scale is interconnected to a main system processor programmed to compute the requisite postage or other transportation charges for an article placed upon the platform. The communications between the main system processor and major peripherals is via the Echoplex communications routine or protocol. These peripherals may include electronic postage meters, an electronic accounting system, and printers such as the Pitney Bowes Model 5976 printer.

Another arrangement for interconnecting a postage value determining system processor with a plurality of peripheral devices associated with mailing system is described in U.S. Pat. No. 4,308,579 to Daniel F. Dlugos entitled "Multiprocessor Parcel Postage Metering System Having Serial Data Bus," and assigned to the assignee of the present invention. That system included a serial communications but through which the peripheral devices communicated with the system processor. Some peripherals were interconnected to the serial communications bus by a separate peripheral controller, while a meter setting device was directly linked to the serial communications bus. Appropriate signals were transmitted along an attention line when it was desired to select a peripheral which would receive or transmit via the shared communications bus. Acknowledgement lines were also provided to acknowledge receipt of signals. The serial communications controller comprised an integral part of the main postage calculator system circuit board.

There is a need for a separate and discrete converter capable of supporting exchange messages of different protocols between a host, such as a stand-alone scale or a computer (PC) and a mailing machine and integrally enable mailing machine trip capability. More particularly, there is a need for a discrete RS-232 to Echoplex two-way protocol converter having integral mailing machine trip capability. While the interface described in the above-mentioned Duwel and Soderberg U.S. Pat. No. 4,535,421 is capable of providing such protocol conversion, that unit does not possess the ability to provide mailing machine trip functionality.

SUMMARY OF THE INVENTION

It is a primary object of the present invention to provide a discrete and unitary interface device or converter which meets the foregoing need.

It is another object of the invention to provide, in a compact accessory form, a transparent interface between a first device utilizing serial communication and a second device utilizing Echoplex communication which will enable real time data communication, and which will provide the capability to trip a mailing machine or the like.

In accordance with the present invention, a transparent interface apparatus provides real time data communication between a host, which transmits and receives messages in accordance with industry standard RS-232 physical layer protocol, and a second device which transmits and receives messages in accordance with Pitney Bowes Echoplex link layer protocol, including in the exchanged messages an external tape request signal which provides current to the mailing machine input to signal a tape request. That signal consists of two parts, namely TRIP, and TRIPRET. This signal is provided via a circuit including adequate resistive protection for a potential short condition which may be caused by the trip solenoid of the postage meter.

The interface or converter receives Echoplex messages on its associated port, and converts them to a format suitable for output to the associated RS-232 port. Correspondingly, the converter receives serial RS-232 messages on its associated port, converts them to the equivalent Echoplex format, and outputs them on the associated Echoplex port. The inclusion of trip circuitry in the converter unit allows scales or other devices which communicate via RS-232 protocol, the ability not only to set Echoplex postage meters, as with the protocol converter described in the Duwel et al. U.S. Pat. No. 4,435,421 patent, but also to trip or trigger a mailing machine or other device. The converter supports attachment between a 9.6 KBaud Echoplex protocol and a host product, such as a scale, communicating via a 9.6 KBaud link layer protocol data format in compliance with RS-232. Power for the converter may be supplied from the host device. The host interface may be an RS-232, full duplex, 9.6 KBaud host computer configured as a Data Terminal Equipment (DTE) device. The Echoplex device interface supports half duplex Echoplex protocol as described in the above-mentioned patents at 9.6 KBaud with no necessity for application layer formatting by the converter.

Other objects of the present invention will be obvious in part and in part will be pointed out hereinafter.

With the foregoing ends in view, the invention finds embodiment in certain combinations of elements, arrangements of parts and series of steps by which the objects aforementioned and certain other objects are hereinafter attained, all as more fully described with reference to the accompanying drawings and the scope of which is more particularly pointed out and indicated in the appended claims.

DETAILED DESCRIPTION OF THE PREFERRED EMBODIMENT

Figure 1:
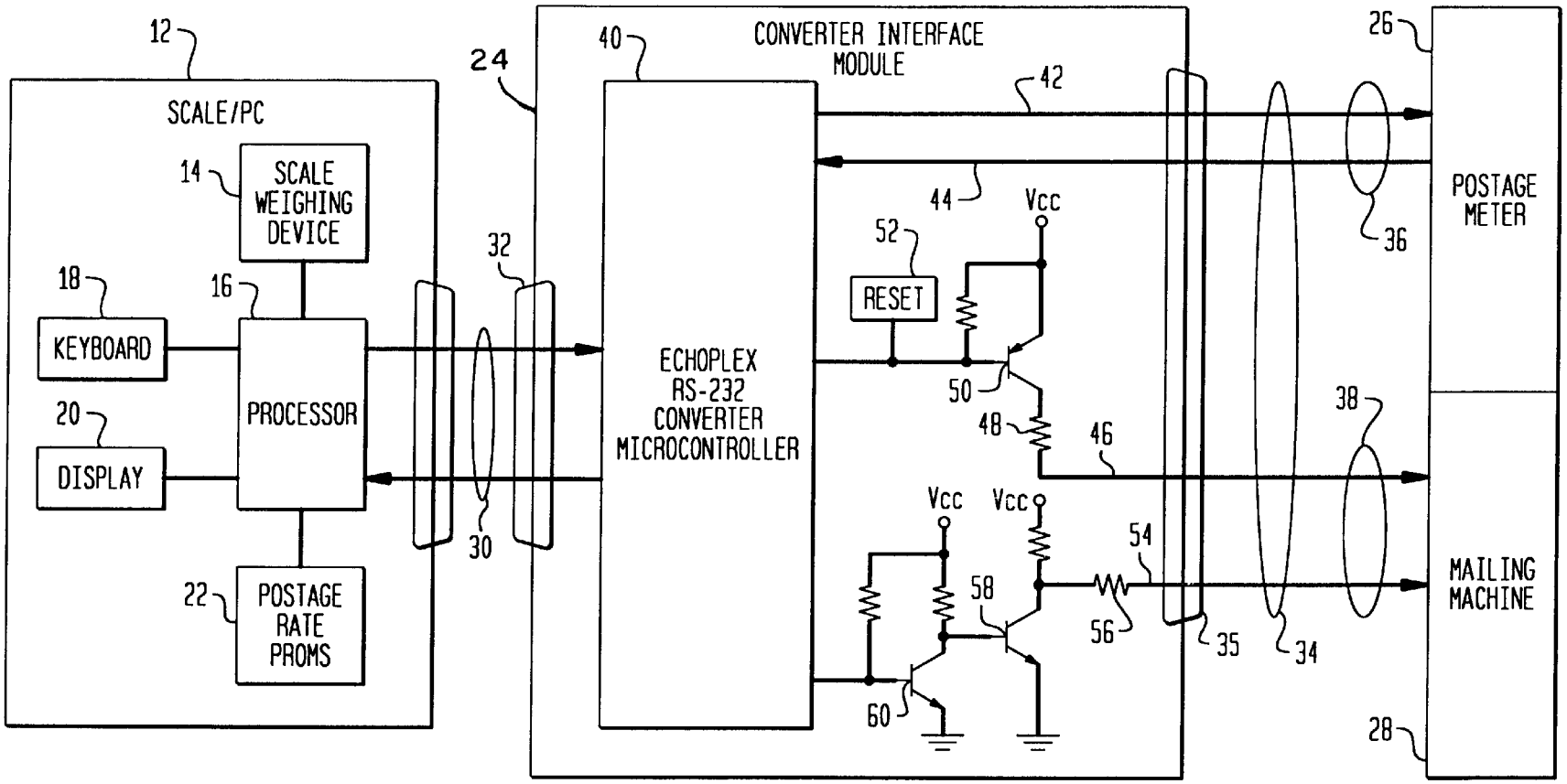
FIG. 1 is a schematic block diagram of a typical postage scale having a postage value determining system processor and a converter interface and schematically illustrates the unique portion of the interface which provides trip capability for controlling one or more peripheral devices such as a postage meter and mailing machine.

Referring now in detail to the drawings, and turning first to FIG. 1 the reference number 12 indicates a processor controlled stand-alone postage scale. The scale 12 is adapted to calculate the postage or other transportation charges required to transport an article. In most instances, transportation charges are based upon the article weight, class of transportation and, with respect to certain classes, distance to destination (zone). The scale 12 includes a weighing device 14 having a tray or platform adapted to receive the article to be mailed. The weighing device 14 is interconnected to a main system processor 16. The system processor 16 is programmed to compute the requisite postage or other transportation charges for an article placed upon the platform.

The data necessary for the determination of article postage, e.g. destination operands, class of transportation operands, etc. may be entered at a keyboard 18 and processor 16. Keyboard and calculated information may be indicated at a display 20.

With the weight, class of transportation and destination zone operands entered, the system processor 16 determines the requisite postage by reference to a postage rate PROM 22 and provides a signal to the display 20 for indicating the calculated postage amount. The postage machine may be provided as a stand alone unit which need not incorporate an interface for communication with mailing system peripheral devices.

According to the invention a converter interface 24 is provided as a separate and discrete self contained plug-in module. The converter module is so constructed as to provide communications links between the postage scale 12 and an electronic postage meter 26 and mailing machine 28. The processor controlled stand alone postage scale may be programmed to communicate in standard serial RS-232 protocol, while the electronic postage meter 26 and its system processor may be programmed to communicate in the Echoplex format.

The computer interface module 24 is connected to the scale 12 by a cable 30 and RS-232 connector 32. The connector 32 on the converter interface module 24 may be an RS-232 9 pin D shell sub miniature shielded connector. It will be appreciated that other equivalent connectors may be used. The connector at the scale 12 may be a similar connector. The computer interface module is connected to the postage meter 26 and mailing machine 28 by a cable 34. The cable 34 is bifurcated and divides at a Y to form a postage meter cable 36 and a mailing machine cable 38.

In a specific example, the mailing machine may comprise a base unit that imprints the postage on an envelope or on a paper tape, as is well known. The postage meter mounts on the base unit to constitute a mailing machine assemblage. The cable 34 may connect to the converter interface module housing 24 via another RS-232 9 pin D shell sub-miniature shielded connector 35. Again, any equivalent connector may be used. The connectors at the postage meter 26 and mailing machine 28 may be similar connectors. The converter interface housing preferably comprises a plastic or metal housing of small size, such as, for example, 4 by 3 by 1 inches. The connectors 32 and 35 are preferably axially aligned at opposite ends of the housing for convenience of disposition of the cables and converter interface module.

The converter interface module contains an Echoplex/RS-232 converter and micro-controller 40 of the type described in detail in the above mentioned Duwel and Soderberg U.S. Pat. No. 4,535,421. Power for the converter micro-controller and remainder of the module housed circuitry to be described is preferably obtained from the host device 12. While the exemplary host which is here described as comprising a postage scale, other host devices could equally well be utilized. Thus, the host may constitute a host computer in stand alone form or incorporated in other products. An externally visible display light, such as an LED, is preferably provided to indicate that the converter interface is powered; when connected with a meter, the light is flashing. The power drawn by the converter interface module should be small, preferably no more than 150 milliamperes.

The converter interface includes an Echoplex/RS-232 converter micro-controller 40. The converter micro-controller 40 comprises two one-way simplex circuits diagrammatically shown at 42 and 44. As will be understood, one simplex circuit is used for the transmission of data from a device and the other is used for reception of information by the device. Communication between the converter micro-controller 40 and postage meter 26 is typically at 9.6 KBaud with no application layer formatting performed by the converter. The communication with the host or postage scale interface 12 is also typically 9.6 KBaud RS-232, full duplex, with the host computer or processor configured as a DTE (Data Terminal Equipment) device.

The trip circuitry is now described. The trip lead 46 connects through a 10 ohm resistor 48 pull-up to the current limited supply voltage Vcc, which typically may be 5 volts DC. The pull-up resistor 48 should have an adequate wattage rating, such as ¼ watt minimum, to protect against a potential short condition of the trip lead 46 to ground by the trip solenoid of the postage meter.

The trip lead resistor 48 connects to the collector of a pnp transistor 50 having its emitter connected to supply voltage Vcc. The base of the transistor is connected to the reset terminal of the converter micro-controller 40. This terminal is also connected to a conventional protective circuit 52 to insure that an inadvertent trip does not occur in a POR (Power-On-Reset) condition.

The TripRet lead 54 is connected through a similar resistor 56 to the collector of an npn transistor 58. The emitter of the transistor 58 is grounded. The transistor base is connected to the collector of a second npn transistor 60 having a grounded emitter. The base of transistor 60 is connected to the converter micro-controller 40.

The operation of the circuit is now described. In its normal or steady operating state condition, the base of the transistor 50, which is connected to the reset pin of the micro-controller, is low and the transistor is in a conducting condition. This places the voltage on the trip lead 46 at supply voltage Vcc. At the same time, the transistor 58, which is controlled from the micro-controller 40, is open or non-conducting. As a result, the voltage on the TripRet lead 54 is also at Vcc, or at the same voltage as the Trip lead 46. Accordingly, there is a zero voltage difference on the leads 46–54 to the trip circuitry of the mailing machine, and there is no current flow.

The firmware in the micro-controller 40 examines the contents of scale messages from the host 12 for a trip command. Upon receipt of this command, the microprocessor will assert the TripRet command signal for a specified time period, such as for example 100–15 mS. Upon de-assertion of the TripRet signal, the micro-controller will resume normal operation allowing the meter's response to the Trip signal to be passed by the converter micro-controller to the scale. The external tape request is generated upon receipt of the TRIP METER command from the RS-232 host 12 with no consideration of the current state of the Echoplex communication port. The converter micro-controller will not convert and transmit this TRIP METER command to the Echoplex meter. The converter micro-controller will discard all messages initiated while the TRIPRET signal is asserted.

When the TRIPRET signal is asserted the transistor 58 goes conductive and presents an open collector path to ground to the line 54. The tape request signal is generated by sinking current through this open collector output for the specified duration. This creates a negative going pulse to the mailing machine 28 and initiates a tape request and trip sequence which results in the imprinting of a postage value.

Figure 2:
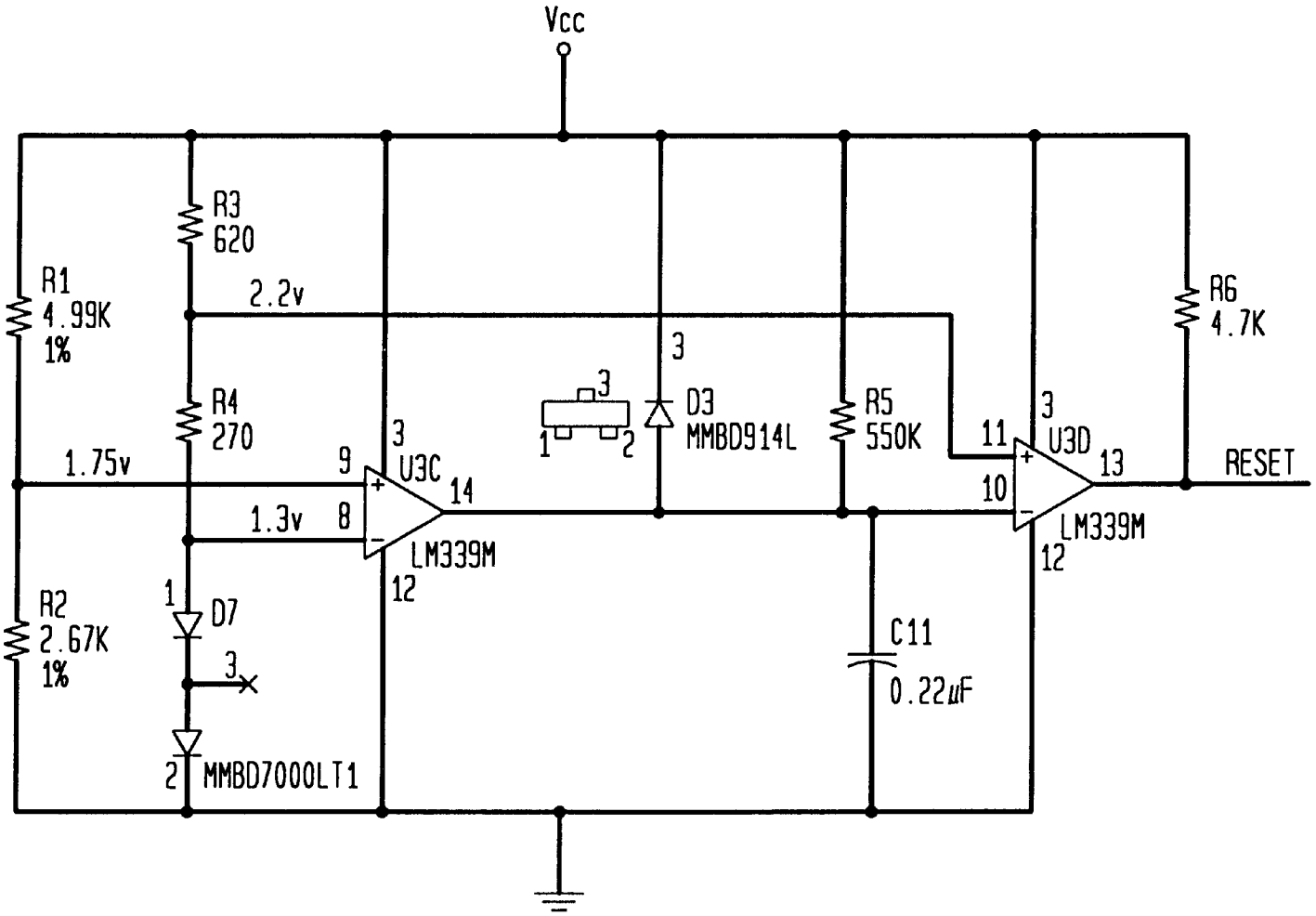
FIG. 2 is a circuit diagram of a reset unit which may be used in the converter and trip enabling device illustrated in FIG. 1.

A typical circuit for the reset unit is shown in FIG. 2. The reset unit simply insures that powering up does not result in an inadvertent trip. Thus, when a reset signal is delivered to the converter micro-controller, a signal is simultaneously sent to the transistor 50 to render that transistor non-conductive or open to disconnect the trip line 46 from the supply Vcc. When this occurs there is no supply voltage difference existing on the lines 46 and 54 and no current flow.

At power on the reset circuit 52 momentarily goes high to reset the micro-controller 40. At the same time the high is applied to the base of the transistor 50 to create the above described reset sequence.

It will be appreciated from the foregoing that the invention provides in a compact accessory form, a transparent interface between a first device utilizing serial communication, such as RS-232, and a second device utilizing Echoplex communication, which enables real time data communication, and which provides the capability to trip a mailing machine or the like. This functionality has not been heretofore possible with available serial to Echoplex converters.

While the foregoing has described what are considered to be preferred embodiments of the invention, it is understood that various modifications may be made therein and that the invention may be implemented in various forms and embodiments, and that it may be applied in numerous applications, only some of which have been described herein. It is intended by the following claims to claim all such modifications and variations which fall within the true scope of the invention.

What is claimed is:

1. In a mailing system including a host device, such as a postage scale or a host computer, and including a postage meter and mailing machine for printing postage indicia, an interface device including:

a) a converter micro-controller for:

(i) translating serial data from said host device into an Echoplex format (ii) outputting said Echoplex formatted data to said postage meter (iii) converting Echoplex formatted data from said postage meter to serial form; and for (iv) outputting said serial form data to said host device; and (b) trip signal generating means associated with said converter micro-controller, said trip signal generating means connected to said mailing machine and delivering thereto a trip signal to actuate a trip operation.

2. The apparatus of claim 1 wherein said interface device is controlled by said converter micro-controller and produces an independently powered trip signal to actuate said trip operation in said mailing system.

3. The apparatus of claim 1 wherein said trip signal generating means, responsive to a signal from said converter micro-controller produces trip operation current flow in said mailing machine.

4. The apparatus of claim 1 wherein said trip signal generating means, responsive to a signal from said converter micro-controller produces trip operation current flow in said trip signal generating means and in said mailing machine.

5. The apparatus of claim 4 wherein said current flow in said trip signal generating means is transistor to transistor current flow.

6. The apparatus of claim 5 wherein said transistor to transistor current flow is powered by a supply derived from said host device.

7. The apparatus of claim 6 wherein said transistor to transistor current flow is through resistor circuitry providing protection against excess current flow caused by a short condition in said mailing machine.

8. The apparatus of claim 6 wherein said transistor to transistor current flow comprises collector to emitter current flow.

9. Apparatus for interfacing an electronic postage meter using Echoplex data communication to a serial communication host computer to provide real time data communication between said postage meter and said host computer, said apparatus comprising:

(a) a microprocessor having a serial data port and an Echoplex data port;

(b) means within said microprocessor for converting serial data from said serial formatted data port into an Echoplex format and for outputting said Echoplex formatted data from said Echoplex data port;

(c) means within said microprocessor for converting Echoplex data from said Echoplex port into a serial format and for outputting said serial data from said serial data port; and (d) trip signal generating means connected to a trip signal power source and to a trip signal terminal; said trip signal generating means being controlled by said microprocessor so that, upon said trip signal generating means receiving a predetermined control signal from said microprocessor, said trip signal generating means causes connection of said trip signal power source to said trip signal terminal.

10. The apparatus of claim 9 wherein said apparatus includes reset means, said reset means being connected to said microprocessor and to said trip signal generating means, said microprocessor and said trip signal generating means and said reset means being connected to a common power supply, wherein upon connection of said power supply to said microprocessor and to said trip signal generating means and to said reset means said reset means delivers a reset signal to said microprocessor and to said trip signal generating means.

11. The apparatus of claim 9 wherein said trip signal generating means includes bipolar transistor circuitry connecting said trip signal power source to said trip signal terminal to provide at said terminal a voltage differential substantially equal to the voltage of said trip signal power source.

12. The apparatus of claim 11 wherein said voltage differential is maintained at said trip signal terminal for a predetermined time period.

13. The apparatus of claim 12 wherein the duration of said time period is controlled by said microprocessor.

14. The apparatus of claim 13 wherein said transistor circuitry includes resistive overload protection means.

15. A unitary and discrete interface module for interfacing an electronic postage meter using Echoplex data communication to a serial communication host computer to provide real time data communication between said postage meter and said host computer, said apparatus comprising:

(a) a converter device for converting serial data signals to Echoplex data signals and Echoplex data signals to serial data signals to provide said real time data communication between said postage meter and said host computer, and (b) a trip signal generator for generating a trip signal for a mailing machine, said trip signal generator being connected to and controlled by said converter and including transistor circuitry providing to said mailing machine a supply source for signal voltage, said supply source providing said voltage for a predetermined duration under control of said converter.

16. An interface module according to claim 15 wherein said converter and said trip signal generator are connected to a common power supply derived from said host computer, and wherein said supply source for signal voltage is derived from said host computer.

17. An interface module according to claim 16 wherein said host computer comprises a scale.

* * * * *